United States Patent [19]

Silver

[11] Patent Number: 4,498,593

[45] Date of Patent: Feb. 12, 1985

[54] MODULAR SHELF STRUCTURE

[75] Inventor: William Silver, New York, N.Y.

[73] Assignee: Thomson-Leeds Company Inc., New York, N.Y.

[21] Appl. No.: 471,230

[22] Filed: Mar. 2, 1983

[51] Int. Cl.[3] ..... A47F 7/00

[52] U.S. Cl. ..... 211/49 D; 312/42

[58] Field of Search ..... 211/49 D, 90, 187, 153; 248/205.3, 1; 206/509, 44.12; 220/23.6, 23.83; 312/111, 42

[56] References Cited

U.S. PATENT DOCUMENTS 2,813,767 11/1957 Berg et al. ..... 211/59.2 X
3,927,809 12/1975 Klein, Sr. ..... 312/42 X
4,425,012 1/1984 Kley ..... 248/205.3 X

FOREIGN PATENT DOCUMENTS 2036707 7/1980 United Kingdom ..... 211/59.2

*Primary Examiner*—Ramon S. Britts
*Assistant Examiner*—Sarah A. Lechok
*Attorney, Agent, or Firm*—Howard C. Miskin

[57] ABSTRACT

A row divider shelf module for holding and dispensing cigarette packs and for use with a pair of transversely spaced resilient vertical strip panels and a rearwardly spaced rear wall includes an upwardly forwardly inclined base plate, an upwardly rearwardly inclined rear wall and skirt walls depending from the base plate edges and the upper edge of the rear wall. Located on each of the side skirt walls is a rear stop having a rear forwardly outwardly inclined cam face and a parallel front channel-shaped stop, the module being inserted between the strip panels which are spread by the stop cam faces and then return to be embraced between respective front and rear stops. A pad having a pressure sensitive adhesive rear face is located on the module rear face and engages the rear wall.

7 Claims, 8 Drawing Figures

FIG. 3
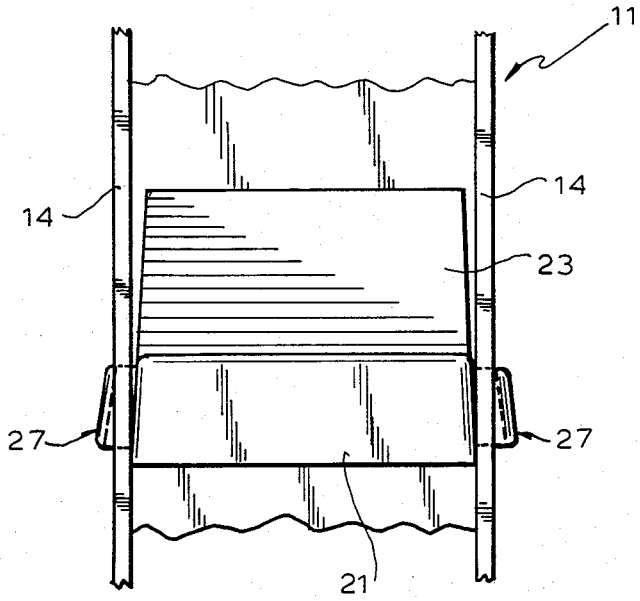
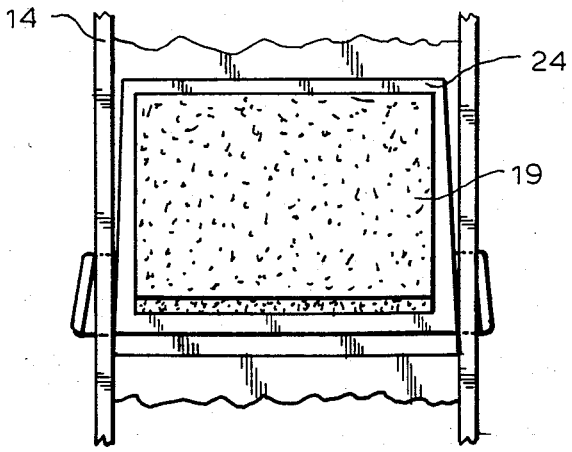
FIG. 4

FIG. 5
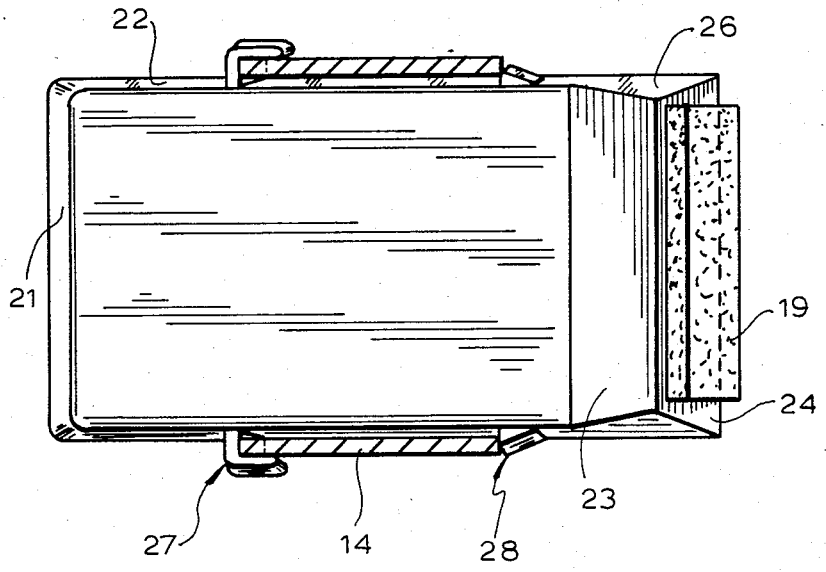
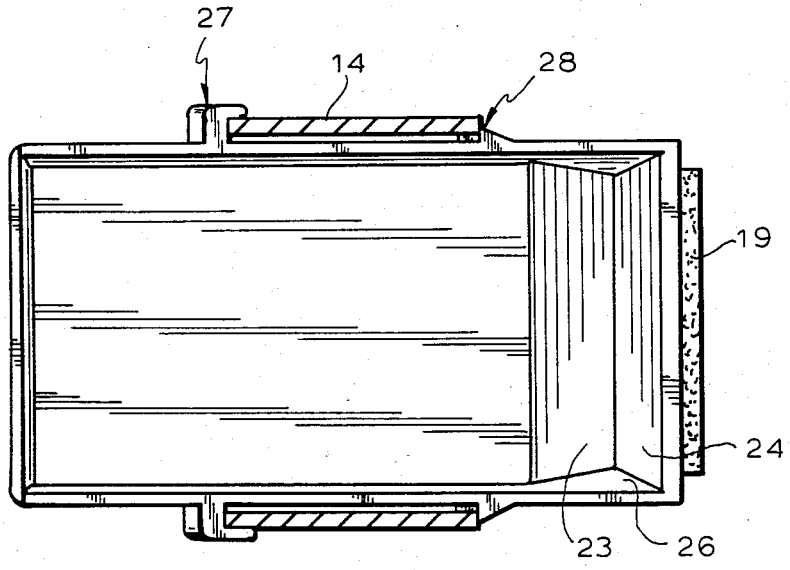
FIG. 6

MODULAR SHELF STRUCTURE

BACKGROUND OF THE INVENTION

The present invention relates generally to improvements in storing and dispensing articles and it relates more particularly to an improved row divider shelf module for facilitating the shelving and dispensing of such articles as cigarette packs.

In the storing and the manual dispensing of individual packs of cigarettes it is a common practice to stack the cigarette packs in side-by-side vertical channels against a rear wall. Such an arrangement while simple possesses numerous drawbacks and disadvantages. By reason of the large number of brands of cigarettes available and requested, in order to accommodate these different brands it is often necessary to horizontally subdivide each of the channels so that more than one brand is available in each channel. However such subdivided channel structures are generally awkward of little adaptability and versatility, often expensive and inconvenient and difficult to install, frequently difficult to properly and expeditiously use and otherwise leave much to be desired.

SUMMARY OF THE INVENTION

It is a principal object of the present invention to provide an improved storing and dispensing structure.

Another object of the present invention is to provide an improved structure for storing and manually individually dispensing different articles of similar shape, such as packs of cigarettes.

Still another object of the present invention is to provide an improved shelf module for supporting a stack of cigarettes in a condition facilitating the manual dispensing of individual cigarette packs.

A further object of the present invention is to provide an improved shelf module which may be rapidly and easily coupled to an associated support structure at any desired position on the support structure.

Still a further object of the present invention is to provide a module and structure of the above nature characterized by their simplicity, ease of application, ruggedness, low cost, convenience of use and operation and great versitility and adaptibility.

The above and other objects of the present invention will become apparent from a reading of the following description taken in conjunction with the accompanying drawings which illustrate preferred embodiments thereof.

A storage and dispensing structure in accordance with the present invention comprises a vertical support member disposed forwardly of a rear support wall and an improved shelf module. The shelf module includes a forwardly projecting base and an upwardly projecting rear wall, a pair of transversely spaced stop member located along a side of the base and embracing the support member to restrict the transverse movement of the module and a retainer pad located on the module rear wall and having a pressure sensitive adhesive on its rear face engaging the support wall to restrict the vertical movement of the module.

In the preferred form of the improved structure a pair of support member defining laterally spaced resilient vertical bands or strips are provided and the shelf module extends between the support strips. The shelf module is integrally formed of a plastic and comprises a forwardly upwardly inclined rectangular panel with front and side depending skirt walls. A pair of the stop members is formed on each of the side skirt walls and embraces a respective support strip, the rear stop member having a forwardly outwardly inclined rear outer cam defining face and the forward stop member being channel shape and engaging the respective strip front border. The module rear wall includes a vertical rear panel and a downwardly forwardly inclined front panel extending between the base panel rear edge and the rear panel top edge. The retainer pad is adhered to the rear panel rear face.

The improved shelf structure and module are rugged, inexpensive, simple and easy to assemble, convenient to use and of great versitility and adaptability.

BRIEF DESCRIPTION OF THE PREFERRED EMBODIMENTS

FIG. 3 is a front elevational view of the mounted shelf module;

FIG. 4 is a rear elevational view;

FIG. 5 is a top plan view;

FIG. 6 is a bottom plan view;

DESCRIPTION OF THE PREFERRED EMBODIMENTS

Figure 1:
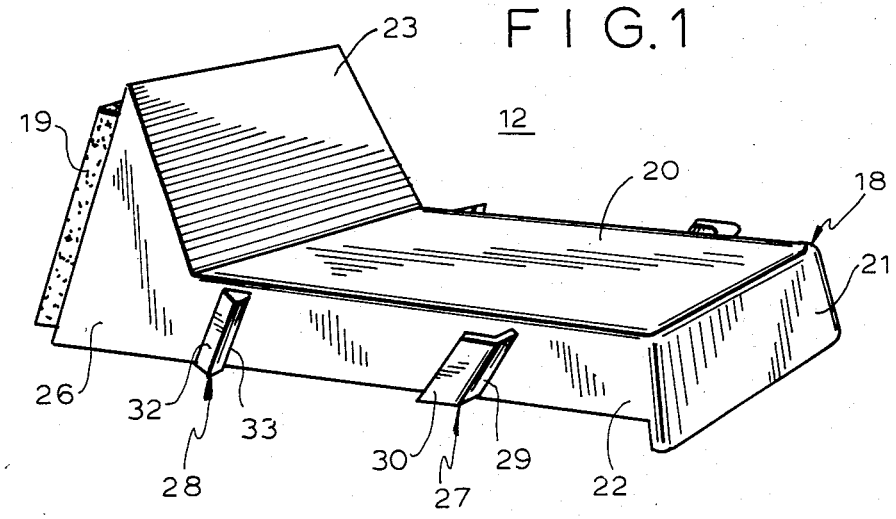
FIG. 1 is a front perspective view of a a shelf module embodying the present invention.
Figure 2:
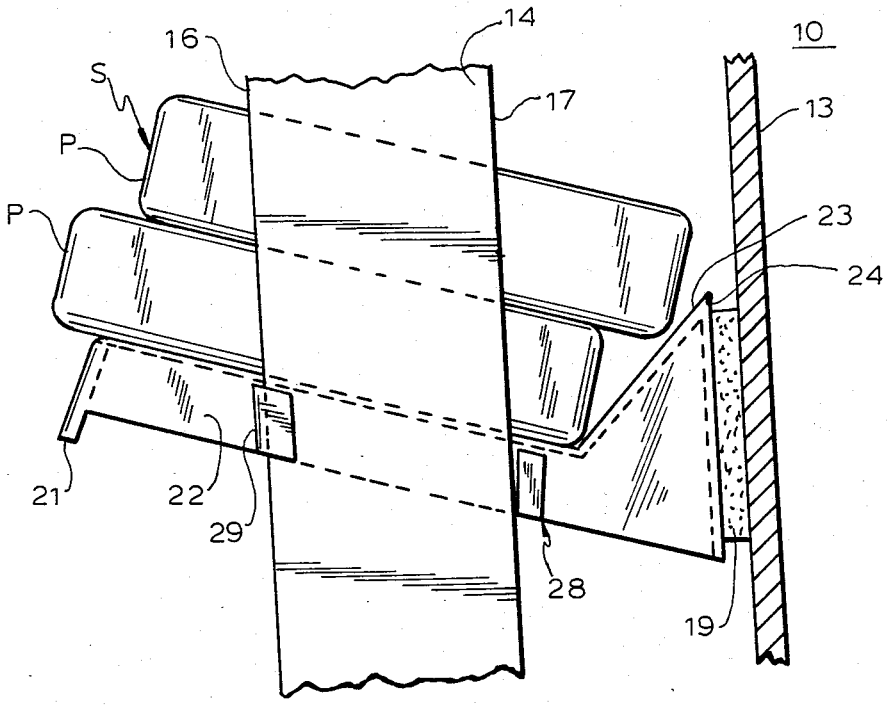
FIG. 2 is a side elevational view thereof shown mounted on an associated support structure.

Referring now to the drawings, particularly FIGS. 1 to 6 thereof which illustrate a preferred embodiment of the present invention as applied to the storage of stacks of cigarette packs and the manual dispensing of the individual packs, the reference numeral 10 generally designates the improved shelf structure which includes a support structure 11 and one or more shelf modules 12.

The support structure 11 includes a vertical laterally extending rear wall 13 and a plurality of suitably supported regularly transversely spaced rectangular row delineating vertical parallel side strips, only two being shown, it being understood that one more strip than the number of rows or columns is provided. The strips 14 are spaced a predetermined distance forward of rear wall 13 and are laterally resiliently flexible and have parallel vertical front and rear edges 16 and 17 respectively.

The shelf module 12 comprises a body member 18 which is integrally formed of a synthetic organic polymeric resin in any suitable manner, for example by injection molding, and a retainer pad 19. The module body member 18 includes a flat rectangular base wall 20 which is forwardly upwardly inclined when the shelf module 12 is in a mounted condition and is of the approximate width and somewhat lesser length than the corresponding dimensions of the face of a conventional cigarette pack. Depending from the front and side edges of base wall 20 are front skirt wall 21 which is adapted to receive an adhesive identification label and parallel side skirt walls 22. Extending upwardly from the rear edge of base wall 20 is a rear wall rectangular front panel 23 which is upwardly rearwardly inclined and forms an obtuse angle with base wall 20 and depending vertically from the top edge of front panel 23 is a rear wall rectangular rear wall panel 24. The adjacent side edges of panels 23 and 24 are joined of triangular vertical side panels 26.

Formed on the outside face of each side skirt wall 22 is a pair of transversely spaced vertically extending front and rear stop or coupling members 27 and 28 respectively. The front stop member 27 includes a vertical leg section 29 projecting outwardly from side skirt wall 22 and terminating in a rearwardly directed flange 30 to delineate with leg 29 a channel which is vertical in the module mounted position. The rear stop member 28 is parallel to front stop member 27 and disposed rearwardly of channel leg 29 by the width of a strip 13. The rear face 32 of stop member 28 is outwardly forwardly inclined to define a pawl or cam and the front face 33 of stop member 28 is parallel to channel leg 29.

The retainer pad 19 is a rectangular block of a resilient or elastomeric synthetic organic polymeric resin sponge material and is adhered or cemented to the rear face of rear wall 24. The outer or rear face of pad 19 is coated with a pressure sensitive adhesive which in the initial unmounted condition of the module is covered by a peelable protective paper sheet or film in the usual manner.

In assembling or mounting a shelf module 12 on the associated support structure, the adhesive protective film or paper is peeled from the retainer pad 19 and the module 12 is inserted, at the desired predetermined level, between a pair of strips 14 and pushed rearwardly. As the module 12 travels rearwardly, stop member cam faces 32 engage the strip front edges 16 to separate the stips 14 and permit the passage of stop members 28. As the module 12 moves rearwardly, front edges 16 enter the channels of front stop member 27 and then engage channel legs 29, at which time rear stop members 28 pass stip rear edges 17 to permit strips 14 to resiliently return to their inner positions engaging module side walls 22 with the stop member front faces 33 engaging strip rear edges 17 to prevent or restrict, with front stop member 27, the transverse front or rear movement of module 12. Concurrently the rear adhesive face of pad 19 is pressed against wall 13 to adhere thereto by reason of the pressure sensitive adhesive on pad 19 whereby to prevent any vertical movement of the shelf module 12.

A stack S of cigarette packs P may be deposited between strips 14 onto shelf base 20, the lower portion of the stack being upwardly rearwardly inclined until the packs reach the rear wall 13 whereupon the stack S extends vertically upwardly The bottom pack P of the stack is urged forwardly by reach wall front panel 23 so as to project the bottom pack forward of the stack to facilitate its manual withdrawal. A plurality of shelf modules 12 may be mounted in the above manner at the desired levels and between selected strips 14 of respective side-by-side successive pairs thereof.

Figure 7:
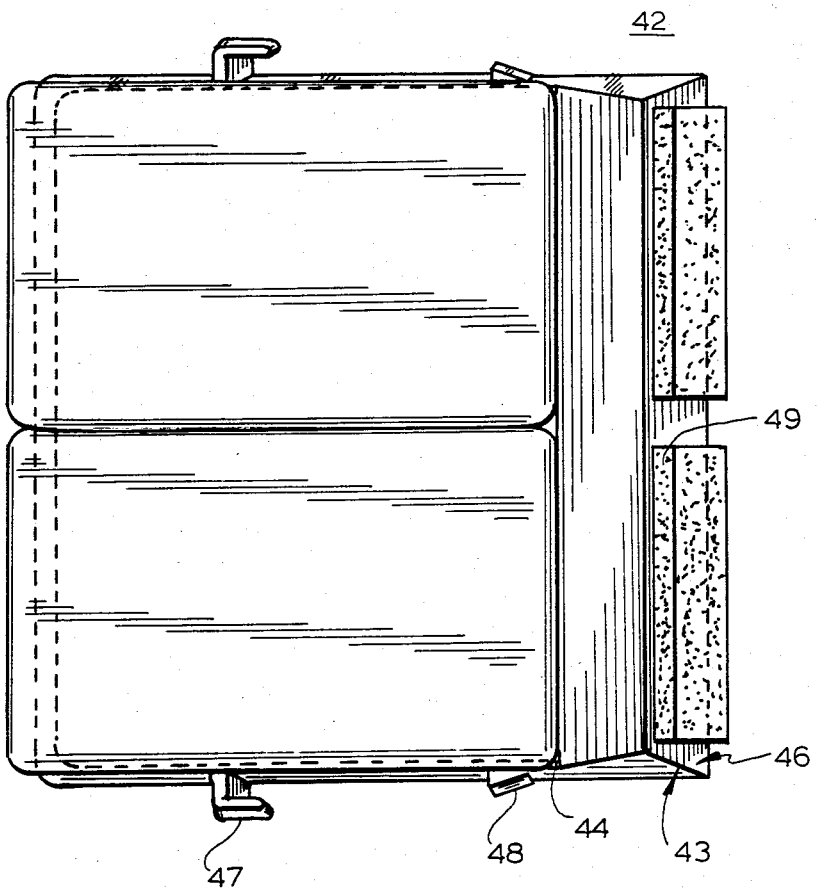
FIG. 7 is a top plan view of another embodiment of the present invention.
Figure 8:
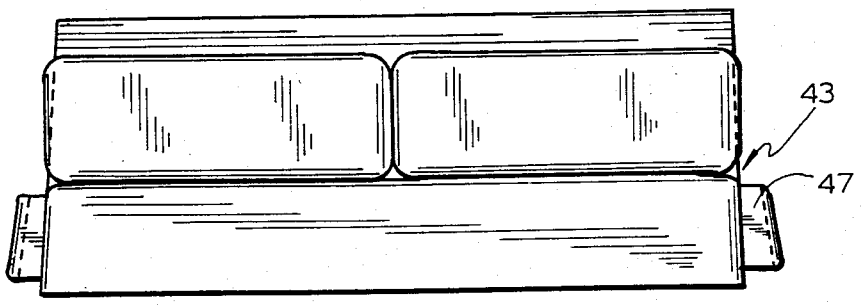
FIG. 8 is a front elevational view thereof.

In FIGS. 7 and 8 of the drawings there is illustrated another embodiment of the present invention which differs from the first described only in that the shelf module 42 is twice the width of shelf module 12 and the resilient support strips of the associated support structure are correspondingly laterally spaced.

Specifically the module 42 comprises an integrally formed body member including a flat rectangular base plate 44 of the same depth and twice the width of the base plate 20 of module 12 and in all other respects the module body members 18 and 43 including stop member 27 and 28 and 47 and 48 are similar. By reason of the increased width of the module rear wall rear panel 46 a pair of laterally spaced rectangular resilient pad 49 corresponding to pads 19 are adherent to rear panel 46 and have pressure sensitive adhesive coated rear faces.

The mounting, application and use of shelf modules 42 are similar to those of module 12 described above except that each shelf module 42 supports a pair of side-by-side stacks of cigarette packs.

While there have been described and illustrated preferred embodiments of the present invention, it is apparent that numerous alterations, omissions and additions may be made without departing from the spirit thereof.

I claim:

1. In combination with a rearwardly disposed vertical wall having a front face and a pair of laterally spaced vertically extending strips lying in planes perpendicular to said wall front face, a shelf module comprising a rear wall having a rear face, a base member projecting forwardly from said rear wall between said strips, a pair of forwardly-rearwardly spaced stop members located on each side of said base member and embracing a respective strip to restrict the forward-rearward movement of said module, said front and rear stop members of each pair thereof delineating a side opening permitting passage of a strip therethrough into the space between said stop members and a pad located on said module rear face and having a pressure sensitive adhesive on its rear face engaging said vertical wall front face to restrict the vertical movement of said module.

2. In combination with a rearwardly disposed vertical wall having a front face and a pair of forwardly disposed laterally spaced resilient strips lying in planes perpendicular to said vertical wall front face, a shelf module extending transversely between said strips and comprising a rear wall having a rear face, a base member projecting forwardly from said rear wall, a pair of forwardly-rearwardly spaced front and rear stop members located on each side of said base member, each pair of said front and rear stop members having confronting faces located along opposite edges of and substantially embracing a respective strip and each of said front stop members including an outwardly projecting vertical section terminating in a rearwardly projecting flange to define a channel engaging the front border of a respective strip and a pad located on said module rear face and having a pressure sensitive adhesive on its rear face engaging said vertical wall front face to restrict the vertical movement of said module.

3. The combination of claim 2 wherein each pair of stop members includes a rear stop member and a front stop member, each rear stop member having a forwardly outwardly inclined cam defining rear face.

4. The combination of claim 2 wherein said base member is forwardly upwardly inclined and of rectangular configuration and includes skirt walls depending from the side edges thereof, said stop members being located on said side walls.

5. The combination of claim 4 wherein said module rear wall includes an upwardly rearwardly inclined front panel and a vertical rear panel depending from the upper edge of said front panel.

6. The combination of claim 5 wherein said module is an integral unit formed of a synthetic organic polymeric resin.

7. The combination of claim 6 wherein said base member is of a width which is an integral multiple of the width of a conventional cigarette pack.

* * * * *